US006257177B1

(12) United States Patent
Lehmann

(10) Patent No.: US 6,257,177 B1
(45) **Date of Patent: *Jul. 10, 2001**

(54) WATER PUMP FOR THE COOLING CIRCUIT OF AN INTERNAL COMBUSTION ENGINE

(75) Inventor: Kai Lehmann, Ludwigsfelde (DE)

(73) Assignee: DaimlerChrysler AG, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/262,180

(22) Filed: Mar. 4, 1999

(30) Foreign Application Priority Data

Mar. 4, 1998 (DE) ..... 198 09 123

(51) Int. Cl.[7] ..... F01P 7/00

(52) U.S. Cl. ..... 123/41.44; 123/41.41; 417/423.1

(58) Field of Search ..... 123/41.4, 41.44; 417/503, 302, 423.1

(56) References Cited

U.S. PATENT DOCUMENTS

| | | | | |
|---|---|---|---|---|
| 2,288,017 | * | 6/1942 | Neuland | 123/41.44 |
| 2,352,203 | | 6/1944 | Johnson . | |
| 4,644,909 | | 2/1987 | Nishikata et al. . | |
| 5,095,855 | * | 3/1992 | Fukuda et al. | 123/41.44 |
| 5,529,026 | * | 6/1996 | Kurr et al. | 123/41.4 |
| 5,617,815 | * | 4/1997 | Spies et al. | 123/41.1 |

FOREIGN PATENT DOCUMENTS

| | | |
|---|---|---|
| 320 400 | 4/1920 | (DE) . |
| 1 476 417 | 10/1971 | (DE) . |
| 17 79 921 | 3/1972 | (DE) . |
| 27 51 201 | 4/1986 | (DE) . |
| 41 25 366 | 3/1993 | (DE) . |
| 43 24 749 | 1/1995 | (DE) . |
| 91 19 818 | 4/1995 | (DE) . |
| 44 16 039 | 8/1995 | (DE) . |
| 44 38 552 | 3/1996 | (DE) . |
| 196 35 044 | 3/1997 | (DE) . |
| 2 667 020 | 3/1992 | (FR) . |
| 1 156 169 | 6/1969 | (GB) . |
| 2 128 318 | 4/1984 | (GB) . |
| 58-110808 | 7/1983 | (JP) . |
| 58-121379 | 7/1983 | (JP) . |
| 1-85419 | 6/1989 | (JP) . |
| 8-200069 | 8/1996 | (JP) . |

* cited by examiner

*Primary Examiner*—John Kwon
(74) *Attorney, Agent, or Firm*—Kenyon & Kenyon

(57) ABSTRACT

A water pump for the cooling circuit of an internal combustion engine. The water pump includes a pump housing and a pump device driven in the pump housing. A servo valve having a rotary gate is integrated in the pump housing. The rotary gate is approximately sleeve-shaped and is provided with an axial main opening for supply or discharge of cooling medium to the suction or pressure side of the pump device. Inlet and discharge openings for a cooler line connected to a cooler and for at least one additional partial circuit are provided in the peripheral wall of the pump housing. The rotary gate has on its peripheral wall a control opening with an opening width through which a connection from the main opening is created to an individual inlet or discharge opening, or an overlapping connection is created to two adjacent inlet or discharge openings for mixed operation.

17 Claims, 4 Drawing Sheets

WATER PUMP FOR THE COOLING CIRCUIT OF AN INTERNAL COMBUSTION ENGINE

FIELD OF THE INVENTION

The present invention relates to a water pump for a cooling circuit of an internal combustion engine.

RELATED TECHNOLOGY

Water pumps are known to be used for the cooling circuit of internal combustion engines using control via thermostats that switch the cooling circuit depending on the temperature. The water pump can be driven mechanically by a belt drive driven by the engine or also electrically. Timed valves, gate valves and rotary valves with stepping motor drives are known in practice for switching the coolant streams and the heating circuit.

German Patent Application No. 43 24 749 A1 describes a control valve for a cooling circuit having a radial inlet and three radial discharges, the coolant being distributed by a rotary valve.

A disadvantage of this control valve is that the rotary valve is constantly subjected to forces that may cause it to seize up and/or requires a suitably powerful drive motor for displacing it. In addition, the displacement or mixed positions are limited.

German Patent No.41 25 366 C1 describes a 3/2-way valve for liquid circuits in motor vehicles having one axial inlet and two radial discharges. The adjustment options of this valves are also limited, so that additional devices are needed for controlling a cooling or heating circuit.

German Patent No. 44 38 552 C1 describes a temperature control device for the cooling circuit of an internal combustion engine, which is provided with actuating elements for a switching gate mounted on a switching shaft. The switching gate shaft is located in the area of an imaginary wall line of the coolant recirculating pipe or pump feed pipe and in the area of junction of the bypass line with the pump inlet. To actuate the switching gate, a temperature expansion element, known as a wax cartridge, is provided.

SUMMARY OF THE INVENTION

An object of the present invention is to provide a control device for the cooling circuit of an internal combustion engine, which contains a plurality of cooling circuit elements and a plurality of actuating and switching element functions in a very compact design.

The present invention therefore provides a water pump for the cooling circuit of an internal combustion engine, in particular of a motor vehicle, comprising a pump housing and a pump device driven in the pump housing, in particular a centrifugal pump, characterized in that a servo valve (5) having a rotary gate (6) is integrated in the pump housing (1), the rotary gate (6) being at least approximately sleeve-shaped and being provided with an axial main opening (7) for the inlet or discharge of cooling medium to the suction or pressure side of the pump device (3), inlet and discharge openings (9, 10, 11) being provided in the peripheral wall of the pump housing (1) for a cooler line (8) connected to the cooler and for at least one additional partial circuit, the rotary gate (6) having a control opening (13) in its peripheral wall with an opening width through which a connection from the main opening (7) to an individual inlet or discharge opening (9, 10, 11) or for a mixed operation to two adjacent inlet or discharge openings (9, 10, 11) is created.

By integrating the servo valve in the water pump housing according to the present invention, a very compact component is achieved, with several switching servo valve positions being possible if the servo valve is properly designed, so that additional control elements in a cooling circuit or possibly a heating circuit of an internal combustion engine can be omitted if necessary. In this case, not only the different functions or switching positions can be implemented, but also the mechanical components required for control can be accommodated in the pump housing or fange mounted onto the pump housing.

With a design according to the present invention , the entire cooling and possibly heating circuit can be controlled virtually with a single device in many of the cases that may occur in practice. With a servo valve according to the present invention, individual openings can be controlled, while mixed operation is also possible, so that no additional control elements are needed in the cooling and heating circuit.

With a design of the servo valve according to the present invention as a rotary valve with axial inlet or discharge of coolant and inlet and discharge openings on the periphery of the pump housing, no resulting forces arise on the rotary valve, so that the rotary valve requires low actuating and holding forces. In addition, only low pressure drops occur in the servo valve according to the present invention, while actuation speeds are high.

The axial opening in the rotary valve is used for supplying coolant to its interior when the rotary valve is located on the pressure side of the pump device. In this case, the openings located on the peripheral wall of the pump housing represent outlet openings for forwarding the coolant.

Conversely, if the rotary valve is located on the suction side of the pump device, the coolant is discharged via the axial opening to the suction side of the pump, and the pump is fed via the control opening by the openings located on the peripheral wall of the pump housing.

When a simple temperature expansion element is used, such as a wax cartridge, as a drive for the rotary valve, two partial circuits are provided in the peripheral wall of the pump housing: the first partial circuit for the cooler line and the second for the cooling water bypass line during the warm-up phase.

When a servo motor is used for the rotary valve, a plurality of partial circuits with the respective inlet and discharge openings in the peripheral wall of the pump housing may be provided. In one possible embodiment, an additional partial circuit for a bypass line and a third partial circuit for a heat exchanger of a heating circuit are provided in addition to the partial circuit for the cooler line.

As an alternative or in combination, a partial circuit may also be provided for an additional heating system and/or an exhaust gas heat exchanging device.

BRIEF DESCRIPTION OF THE DRAWINGS

Advantageous refinements and embodiments of the present invention are described with reference to the drawings, in which.

DETAILED DESCRIPTION

Figure 8:
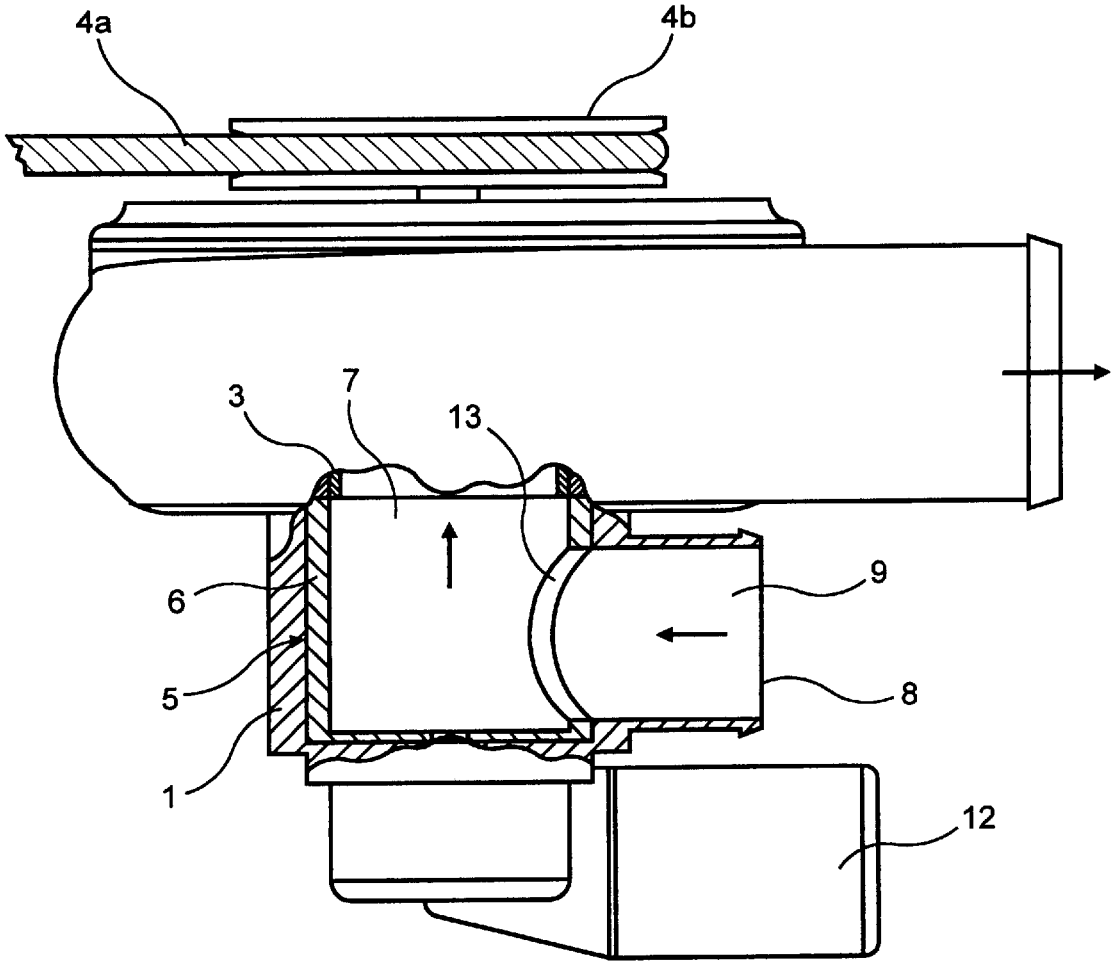
FIG. 8 shows a partial section of a belt driven pump.

The water pump illustrated in the figures is basically of the known design; therefore, in the following only parts pertaining to the present invention will be described in detail. Thus, the water pump may be a centrifugal pump mounted in a pump housing 1 with an impeller 3 located in a helical channel 2. Impeller 3 is driven in the known manner using a drive motor 4. As an alternative to driving the water pump via drive motor 4, a mechanical drive via a belt drive driven by the internal combustion engine, having a V-belt, for example, may also be used (See the belt-driven pump shown in FIG. 8, in which 4*a* represents a portion of a belt, which rotates pump drive wheel 4*b*, in order to drive the pump).

A servo valve 5 having a rotary gate 6 in the form of a sleeve is mounted in an axial extension of pump housing 1 or in the area of the inlet, present in the usual manner, of impeller 3 of the water pump, the longitudinal axis of the rotary gate being coaxial with the longitudinal axis of the pump and of impeller 3. An axial main opening 7 of rotary gate 6 forms an inlet opening to impeller 3 of the water pump. A cooler line 8 connected to a cooler (not illustrated) ends at the peripheral wall of pump housing with an inlet opening 9.

As can be seen in FIGS. 3–7, the peripheral wall of pump housing 1 is also provided with two additional inlet openings 10 and 11, which are provided for additional partial circuits of the coolant in the cooling circuit. The face of rotary gate 6 is closed on the side facing away from main opening 7 and it is also provided with a servo motor 12 on this side for moving the rotary gate.

Rotary gate 6 is provided with a control opening 13 on its peripheral wall. Depending on the rotary position of rotary gate 6, connection is established between inlet opening 9, 10 or 11 and main opening 7, and thus with the suction side of impeller 3 of the water pump, via control opening 13.

As can be seen in FIGS. 3–7, different operating positions are possible depending on the rotary position of rotary gate 6, not only for single streams, but also for mixed streams. For this purpose, main opening 13 in the peripheral wall of rotary gate 6 has a width such as to allow both individual streams and mixed operation streams to flow.

Figure 1:
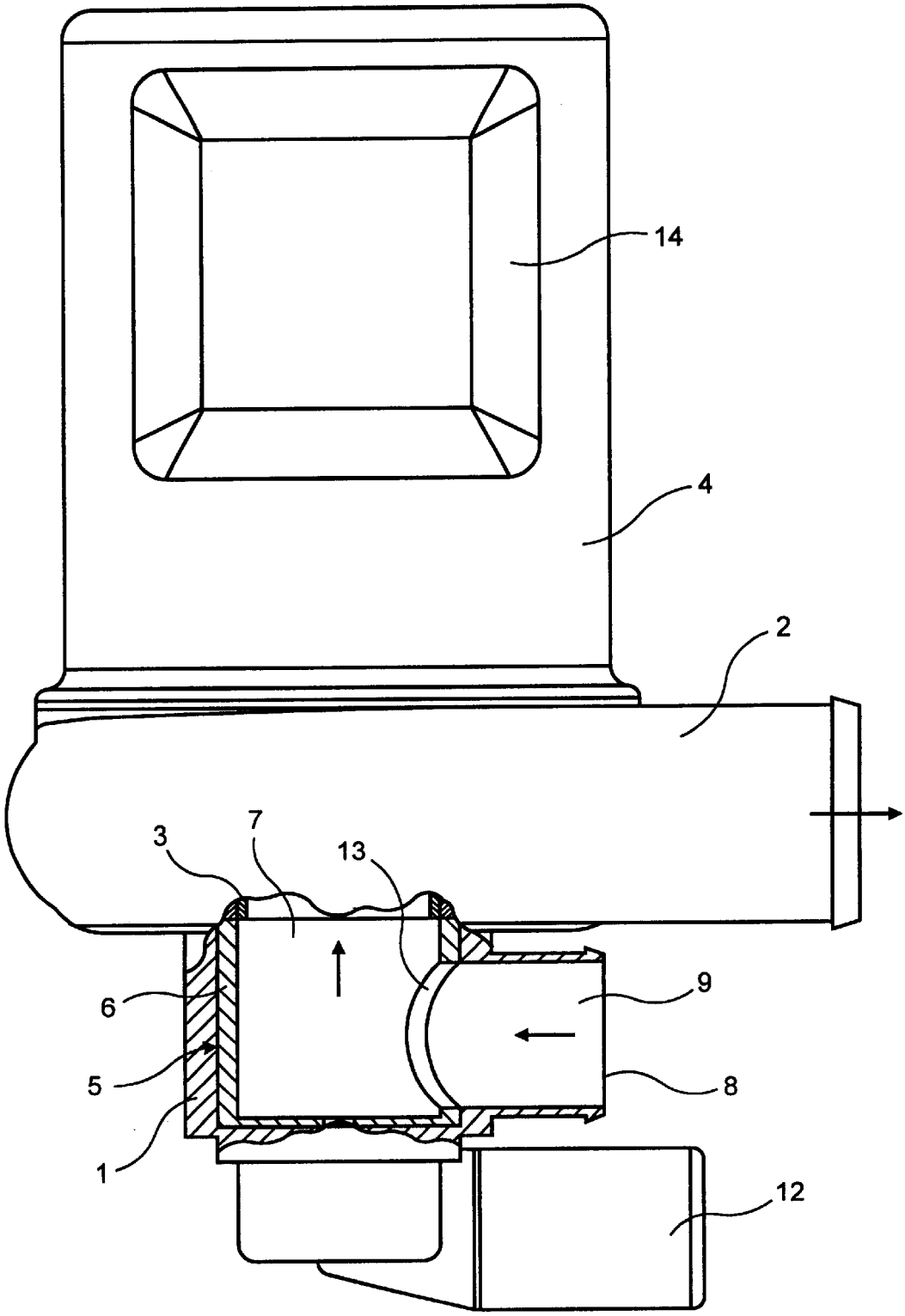
FIG. 1 shows a partial section of a water pump according to the present invention.
Figure 2:
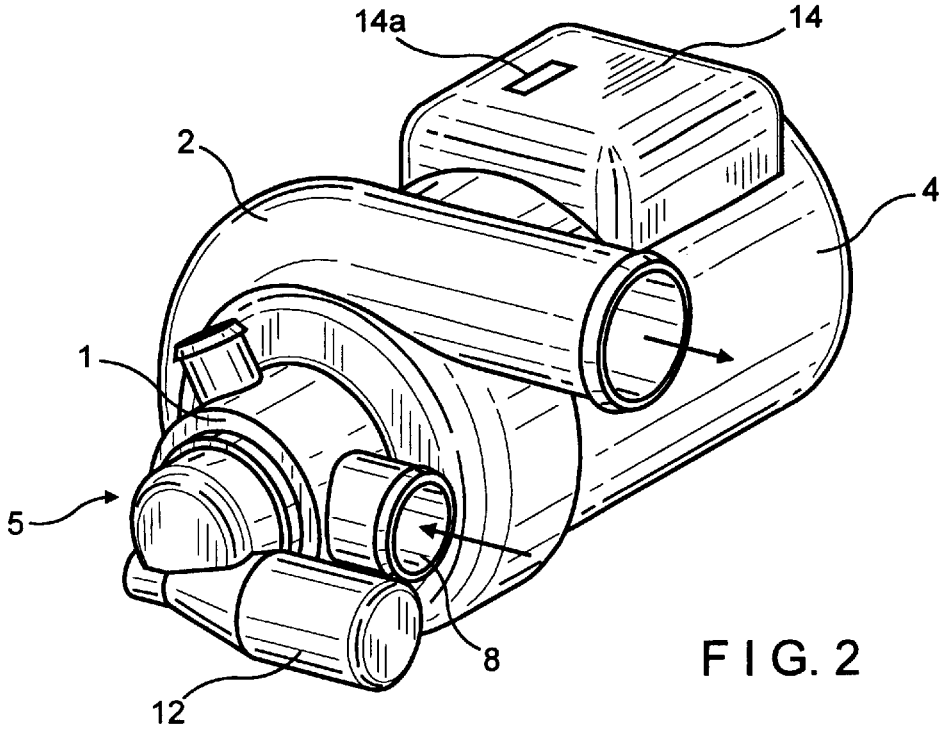
FIG. 2 shows a perspective view of the water pump of FIG. 1.
Figure 3:
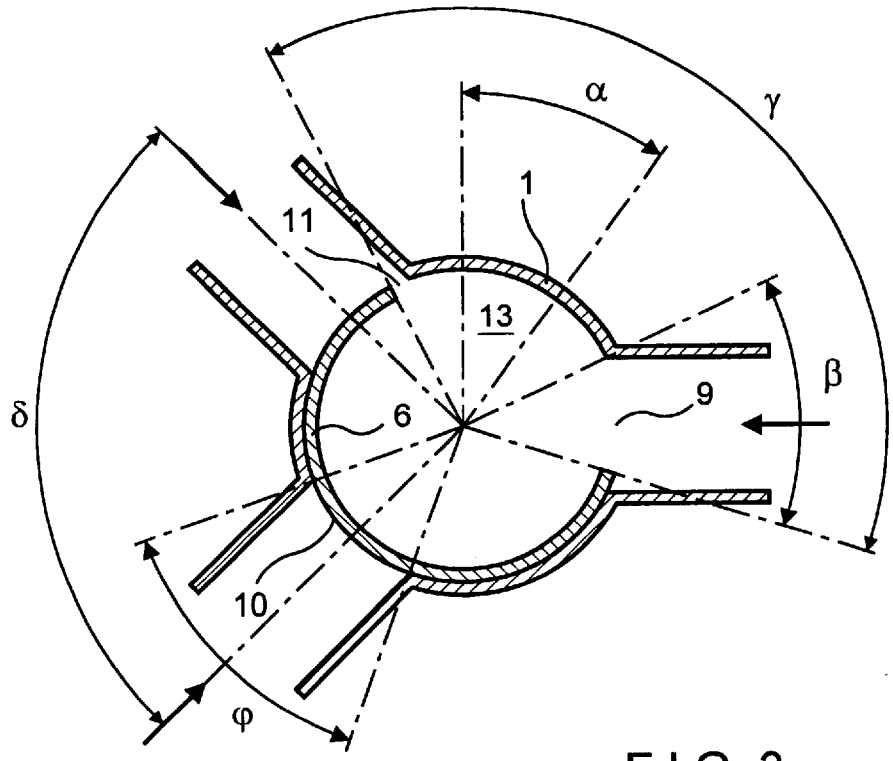
FIG. 3 schematically shows a cross section through a servo valve integrated in the water pump.

According to FIG. 3, in order to accomplish this, the following conditions must be met:

$$\delta < \gamma - \left(\frac{\varphi n}{2} + \frac{\varphi m}{2}\right)$$

$\gamma$ = opening angle of the rotary gate $\delta$ = angle between the nozzles $\varphi$ = angular opening of the fitting nozzles $\beta$ = full opening angle of the respective nozzle $\delta_1+\delta_2+\delta_3=360°$ with the individual angles being the same whenever possible. $\beta_{max}=\phi$ full opening of the cross section.

FIG. 3 shows the angles using sectional representation through the central plane of the fitting cross sections. All angles are directly related to the cross section functions. In addition to the relatively simple shape of a bore for the openings, other, non-circular cross sections can also be selected. Thus an additional degree of freedom can be achieved when establishing the adjustment characteristics.

In the embodiment shown, the connection nozzles project radially from pump housing 1. In order to achieve a more streamlined shape, the connection nozzles may also be positioned on pump housing 1 semi-axially or at an angle to the radial direction.

Figure 4:
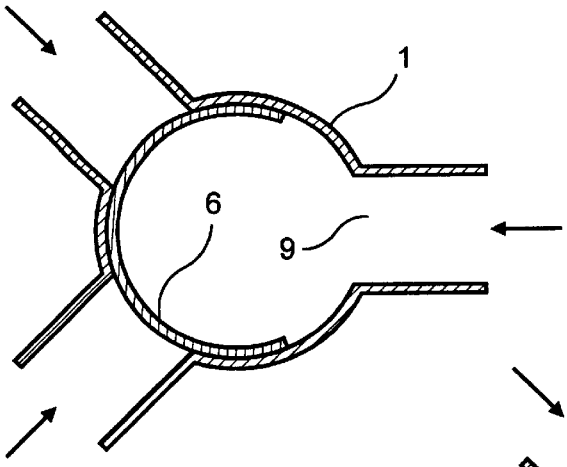
FIGS. 4–7 show different control positions of the servo valve of FIG. 3.
Figure 5:
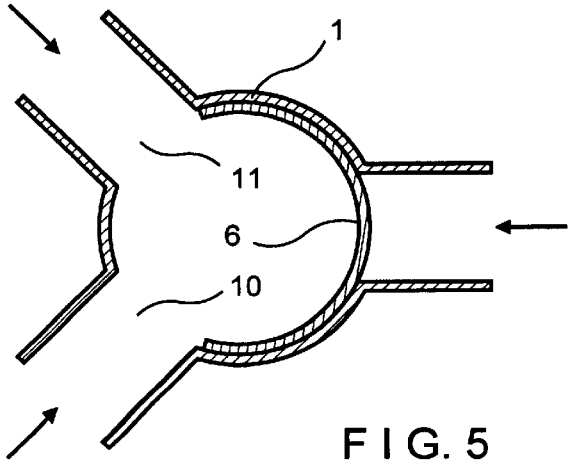
Figure 6:
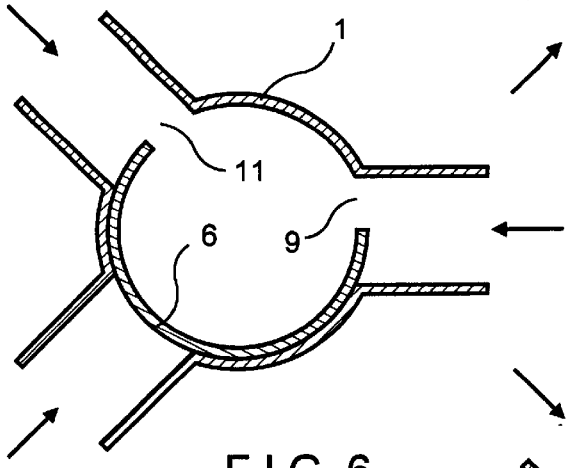

FIGS. 4–7 show several control positions of control device 1. Thus, FIG. 4 shows the position in normal "cooling" operation. FIG. 5 shows a first mixed operation in the warm-up phase of the engine with simultaneous heating, with inlet opening 9 of the cooler line blocked and inlet openings 10 and 11 for the bypass line and the heating circuit open. FIG. 6 shows a second mixed operation in the "warm-up" and "cooling" phase with the heating circuit blocked.

Figure 7:
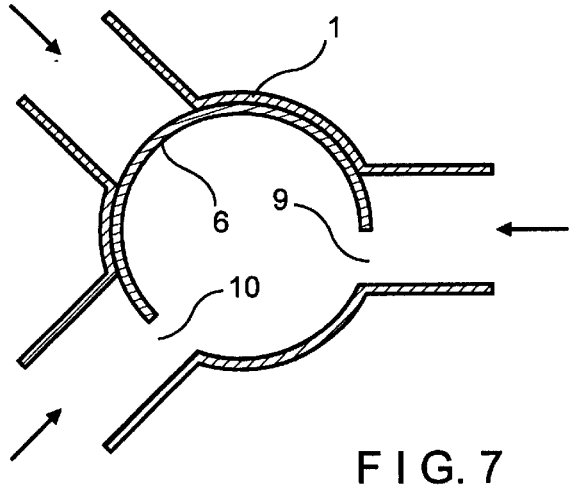

FIG. 7 shows a third mixed "heating and cooling" operation with inlet opening 10 for the short-circuit line blocked.

As in the operation illustrated in FIG. 4, other individual connections are also possible if required between control opening 13 of rotary gate 6 to an individual peripheral opening.

Instead of the heating circuit, a second bypass circuit, e.g. for the cylinder head, can also be provided.

As can be seen, rotary gate 6 can switch each circuit separately. In addition, mixed stages can also be set between any two circuits.

No resulting steam forces capable of producing a torque about the axis of rotation of rotary gate 6 are applied to servo valve 5. This means that no changes may occur in the rotary gate position due to the through flow. Therefore, the drive power of servo motor 12 may also be kept low. Due to the low actuating forces, neither are special bearings needed for rotary gate 6 in normal circumstances. Since cross sections are opened in the radial direction in each angular position, very low pressure drops are also produced across the control device, which makes special seals for the inlet and discharge opening unnecessary.

In the embodiment illustrated, all three inlet openings 9, 10 and 11 are located in the same radial plane, which allows a very short installed length to be achieved.

In a simplified embodiment, servo valve 5 may also be provided with only two inlet or discharge openings in the peripheral wall of pump housing 1. In this case, the peripheral openings are provided for the cooling line and the bypass circuit line. Instead of a servo motor 12, a simple wax cartridge is then sufficient for changing the rotary angle of rotary gate 6. As an alternative, rotary gate 6 may also be provided with a bimetallic strip as an adjustment device.

A peripheral opening may also be provided as a partial circuit for an additional heating system or an exhaust gas heat exchanger. Combinations of different partial circuits are possible within the framework of the present invention.

As may be seen from the embodiment, not only is the entire servo valve integrated in pump housing 1 of the water pump, but the same is true for an electric and also an electronic interface, with the electric interface allowing central power supply of the water pump and servo motor 12 from the on-board system. An electronic interface (or data exchange) 14*a* may be used for central hookup to a data exchange, setpoint definition and an additional information exchange system. For this purpose, both interfaces may be installed in a common housing 14, flange mounted onto pump housing 1 or drive motor 4.

Integrating the servo valve into pump housing 1 offers the option of switching the flow of all essential partial streams in a single cooling circuit. Integration also allows a compact, low-cost and reliable design of a central operating and actuating element for vehicle repairs. A control element for the rotational speed of the water pump is thus extended by the control function for servo valve 5.

With the method according to the present invention, two important features of a cooling system are combined:

1. a water-side temperature control in the cooling circuit;
2. an application of this control for the partial intermediate cooling circuits connected to servo valve 5.

In particular, using a speed-controlled electric water pump and a servo valve 5 that is electrically driven via servo motor 12, accurate temperature control of all partial circuits is possible. Appropriate temperature test points for controlling the pump and the cooling circuit are also integrated in the water pump for this purpose.

What is claimed is:

1. A water pump for a cooling circuit of an internal combustion engine, the water pump comprising:

a pump housing including a first peripheral wall having at least one flow opening for a cooler line connected to a cooler and for at least one partial circuit, the flow opening including at least one of an inlet opening and a discharge opening;

a driven pump device disposed in the pump housing; and a servo valve in the pump housing, the servo valve including an at least partially sleeve-shaped rotary gate, the rotary gate including an axial main opening for at least one of inlet of a cooling medium from a pressure side of the pump device or and discharge of a cooling medium to a suction side of the pump device, and including a second peripheral wall having a control opening capable of at least one of connecting the main opening to two adjacent ones of the flow openings for a mixed operation and connecting the main opening to an individual one of the flow openings.

2. The water pump as recited in claim 1 wherein the cooling circuit is included in a motor vehicle.

3. The water pump as recited in claim 1 wherein the pump device is a centrifugal pump.

4. The water pump as recited in claim 1 further comprising an electric interface in the pump housing for connection to a central power supply system of a vehicle.

5. The water pump as recited in claim 1 further comprising an electronic interface in the pump housing for connection to at least one of a data exchange, setpoint input, and an information exchange system.

6. The water pump as recited in claim 1 further comprising:

an electric interface to a central power supply system of a vehicle; and an electronic interface for connection to at least one of a data exchange, setpoint input, and an information exchange system;

wherein the electric and electronic interfaces are mounted in a common housing, the common housing being flange mounted onto the pump housing.

7. The water pump as recited in claim 1 wherein the rotary gate further includes a wax cartridge capable of being used as an adjusting device.

8. The water pump as recited in claim 1 wherein the rotary gate further includes a bimetallic strip capable of being used as an adjusting device.

9. The water pump as recited in claim 1 wherein the rotary gate further includes a servo motor.

10. The water pump as recited in claim 1 wherein one of the at least one partial circuit is a cooling water bypass circuit.

11. The water pump as recited in claim 1 wherein one of the at least one partial circuit is a heating circuit.

12. The water pump as recited in claim 1 wherein the at least one partial circuit includes at least one of a circuit for a heating system and a circuit for an exhaust gas heat exchange device.

13. The water pump as recited in claim 1 wherein the flow openings are disposed in a same radial plane of the pump housing.

14. The water pump as recited in claim 13 wherein the flow openings are evenly distributed over a periphery of the pump housing.

15. The water pump as recited in claim 1 further comprising a respective connection nozzle attached to each of the flow openings, each connection nozzle extending semi-axially from the respective inlet or discharge opening.

16. The water pump as recited in claim 1 wherein the water pump is capable of being electrically driven via a drive motor.

17. The water pump as recited in claim 1 wherein the water pump is capable of being mechanically driven via a belt drive driven by the internal combustion engine.

* * * * *

UNITED STATES PATENT AND TRADEMARK OFFICE

CERTIFICATE OF CORRECTION

PATENT NO. : 6,257,177 B1
DATED : July 10, 2001
INVENTOR(S) : Kai Lehmann

It is certified that error appears in the above-identified patent and that said Letters Patent is hereby corrected as shown below:

Column 3,
Line 23, after "housing" insert -- 1 --;
Line 55, after "$\beta_{max}$=" change "=φ" to -- φ --; and Column 5,
Line 20, after "device" change "or" to -- and --.

Signed and Sealed this

Third Day of September, 2002

*Attest:*

*Attesting Officer*

JAMES E. ROGAN
*Director of the United States Patent and Trademark Office*